United States Patent [19]

Damm

[11] Patent Number: 4,592,406

[45] Date of Patent: Jun. 3, 1986

[54] APPARATUS FOR COMPACTING FOUNDRY SAND

[75] Inventor: Norbert Damm, Karlsdorf-Neuthard, Fed. Rep. of Germany

[73] Assignee: BMD Badisch Maschinenfabrik Durlach GmbH, Fed. Rep. of Germany

[21] Appl. No.: 607,116

[22] Filed: May 3, 1984

[30] Foreign Application Priority Data

May 11, 1983 [DE] Fed. Rep. of Germany ..... 3317196

[51] Int. Cl.[4] ..... B22C 15/00; B22C 15/08

[52] U.S. Cl. ..... 164/169; 164/37; 164/170; 164/171

[58] Field of Search ..... 164/171, 170, 169, 37, 164/39

[56] References Cited

U.S. PATENT DOCUMENTS

| | | | |
|---|---|---|---|
| 3,952,793 | 4/1976 | Hijikata et al. | 164/170 X |
| 4,067,380 | 1/1978 | McCormack | 164/171 X |
| 4,129,165 | 12/1978 | Edwards | 164/171 X |

FOREIGN PATENT DOCUMENTS

| | | | |
|---|---|---|---|
| 338296 | 6/1972 | U.S.S.R. | 164/170 |

*Primary Examiner*—Nicholas P. Godici
*Assistant Examiner*—J. Reed Batten, Jr.
*Attorney, Agent, or Firm*—Antonelli, Terry & Wands

[57] ABSTRACT

In an apparatus for the compaction of foundry sand by the impact of pressurized gas on the foundry sand as filled into a flask over a pattern plate with a pattern therein, a specially designed diaphragm is used to get an even and constant hardness of the mold in every horizontal plane thereof and/or to put an end to the formation of shear cracks in the mold between different parts of the volume of the sand. This diaphragm is placed over the so far uncompacted surface of the foundry sand and it has a permeability to gas varying with the height of the sand to be compacted so that such permeability is less in the parts with high and/or plateau-like pattern contours than in parts where there is no pattern on the pattern plate.

13 Claims, 4 Drawing Figures

APPARATUS FOR COMPACTING FOUNDRY SAND

BACKGROUND OF THE INVENTION

The present invention is with respect to an apparatus for the compaction of foundry sand by the impact of gas under pressure on the sand filled into a flask over a pattern support plate with a pattern thereon, in the case of which there is a gas permeable diaphragm placed directly over the uncompacted foundry sand and the gas pressure is caused to act on the said gas permeable diaphragm.

DESCRIPTION OF THE RELATED ART

Investigations have already been undertaken on a pressurized gas method of making foundry molds, in which the foundry sand is filled into the mold space walled in by the pattern plate with its pattern, and a gas permeable diaphragm in the form of an auxiliary mass is placed on the free top face of the foundry sand and then gas under pressure is suddenly caused to expand to take effect on the said auxiliary mass. Because the auxiliary mass is loosely heaped, it follows the sinking motion of the surface of the foundry sand when same is compacted. In the auxiliary mass the gas pressure is converted into kinetic energy, that is transmitted to the surface of the said foundry sand. At the same time however—because the auxiliary mass is permeable to the gas—there is an exchange of momentum between the gas and the surface of the foundry sand. Furthermore the gas penetrates into the foundry sand and is responsible for a fluidizing effect therein. In combination with the energy of impact generated by the gas pressure such effect is responsible for a compaction of the foundry sand. Furthermore a suggestion has been made to divide up the auxiliary mass into more than one separate mass and to adapt them to the contour of the pattern in such a way that the mass is smaller over the high contours of the pattern than over the lower contours thereof. The purpose in this respect was more specially to see that the density or hardness of the mold took on more or less the same value at different points over each horizontal plane. However it was then seen from tests under working conditions that this aim was hardly very readily effected. More specially it was to be seen that in the case of patterns, whose contour had considerable differences in height or had a mesa or plateau shape, there were likely to be cracking, running generally in a downward direction, even though the hardness of the mold was as desired. The existence of such cracks made it seem that there had been shear forces acting generally in a vertical direction.

In keeping with other suggestions there was either to be a distribution plate with blow holes therein over the flask with the filling of foundry sand, such holes possibly having different cross sections (see the U.S. Pat. No. 3,170,202) or certain, given parts of the surface, as for example those over the pattern, were to be covered over by a pot-like container (see the German unexamined (Offenlegungsschrift) specification No. 2,949,340) whose walls plunged into the foundry sand and/or whose unperforated bottom wall was placed stationarily at some distance over the surface of the foundry sand. However, neither of these two known forms of apparatus gave the desired compacting effect. In the first case, a mass of craters was produced in the surface of the foundry sand opposite to the blow holes. In the second case the foundry sand under the bottom was kept more or less completely uncompacted, whereas only the part of the surface of the foundry sand outside the container was cratered. It will be clear from this that the trouble condition noted has not been taken care of by such earlier suggestions; on the contrary, there is the further trouble in the form of cratering of the surface of the foundry sand.

SUMMARY OF THE INVENTION

One object of the present invention is that of making such a further development of the apparatus noted hereinbefore that there is a degree of mold hardness that is generally even in any given horizontal plane of the mold.

A further object or aim of the invention is to make possible such an even horizontal hardness of the mold without the formation of cracks within said mold.

For effecting this and further objects the gas permeability of the diaphragm is so matched to the height of the foundry sand to be compacted that such permeability is less at the high and/or plateau-like contours of the pattern than in the pattern-free part of the pattern plate.

Whereas it has been made clear with the method noted hereinbefore that changes in hardness within the mold may be changed by the design of the auxiliary mass so as to match the contour of the pattern, the same purpose is effected in the present invention inasfar as the gas permeability of the diaphragm is matched to the changes in height of the pattern over the pattern plate, or in other words the pressure is caused to take effect more strongly where the compaction stroke is greater (lowering of the surface of the surface of the foundry sand) than where the compaction stroke is small (that is to say where the pattern height is great and extended). Furthermore at such points where there is more compaction more gas will penetrate into the foundry sand as well so that there is more fluidization than at the other points. Tests under working conditions have made it clear that this will put a complete stop to the formation of cracks. The reason for this would seem to be that the compaction produced by the gas pressure (acting by way of exchange of momentum between the grains of sand) and by the fluidizing effect takes place in all parts of the sand volume at the same speed or in the same stretch of time so that each volume of sand will be moved and compacted at the same time as the volumes next to it and there will be neither any relative vertical motion between the volume of sand and the volumes next thereto nor any horizontal compensating displacement that might otherwise be caused by compaction in some parts of the mold being ahead of compaction in other parts thereof.

In keeping with a preferred form of the invention the said effect may be stepped up by zones with different permeabilities to gas in the diaphragm being walled off from each other by separating walls in a vertical direction as well.

These separating walls will be seen to have the effect of walling off, at least for a part of the height of filling, different volumes of foundry sand, that are placed vertically side by side, from each other so that the effects due to the differing gas permeability on the gas pressure wave or front are kept in being and distinct from each other right down into the depth of the mold as well. This will more specially put an end to "short circuit" flows of gas between one volume of sand and the next.

Such separating walls may for example go down as far as the outline or contour of the pattern. The outcome of this will then be that they not only keep separate such volumes of foundry sand in the loosely filled condition but furthermore go down into the part, that is then to be compacted, of the mold.

In keeping with a still further part of the invention the gas permeable diaphragm is partly put in place so as to be immovable and is partly loosely placed on the surface of the foundry sand so that it may move with same. Inasfar as the diaphragm may be so moved it forms an auxiliary mass to be accelerated by the gas pressure, and the kinetic energy of this mass is transmitted to the foundry sand and is responsible for an enhancing or additional compacting effect. In this respect the operation is best so undertaken that the diaphragm is stationary in the part over the pattern, that is to say where less gas permeability is designed for, whereas in the part over the uncovered pattern plate, in which there is to be a greater compaction stroke, it is able to be moved.

In place of this however it is as well possible for all of the gas permeable diaphragm to be placed on the surface of the foundry sand and for it to be able to be moved with same, the conditions then best being such that the amount of mass of diaphragm is less where the pattern contour is high and/or is plateau-like than in the parts where there is no pattern. In such a case the diaphragm is preferably made flexible so that it may keep pace with the differing compaction stroke or displacement.

As a general rule, in methods of mold making using pressurized gas, a filling frame is placed on the flask and the foundry sand is loosely heaped into the flask and the frame. In this case the stationary part of the gas permeable diaphragm is fixed in the filling frame so that it may be kept therein all the time and has no undesired effects on the sinking motion of the flask with the finished mold therein.

In the case of this form of the invention the separating walls are present not only on the stationary part of the gas permeable diaphragm but furthermore on the flask and go right down into the flask. In this way one may be certain that the separating walls will not have any undesired effects on the motion of the flask.

As part of a still further useful development of the invention the gas permeable diaphragm is formed by two or more perforated plates with a cross section of the holes therein in line with the desired permeability to the gas.

An account will now be given of the invention using the figures herein, same representing one working example of my invention.

DETAILED DESCRIPTION OF THE PREFERRED EMBODIMENT

Figure 1:
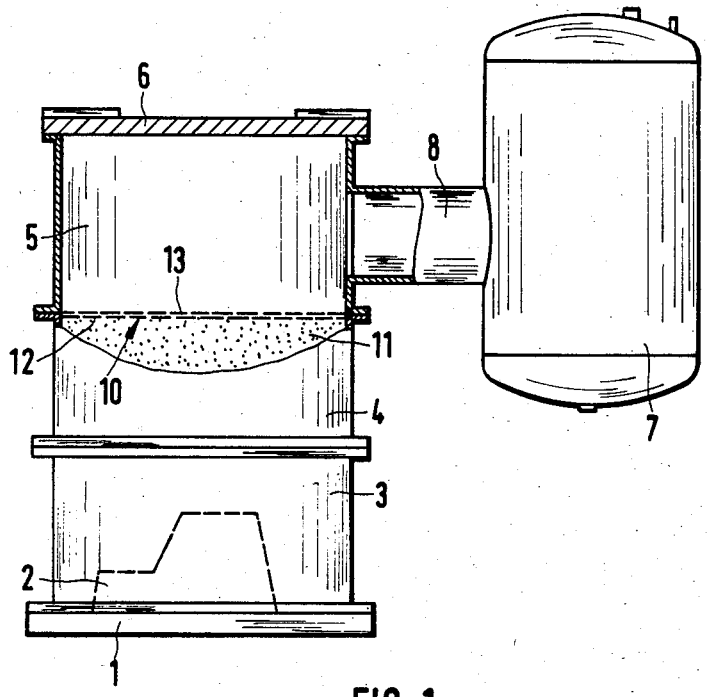
FIG. 1 is a diagrammatic view and part section of the more important parts of an apparatus for the gas compaction of molds.

Turning now to the figures and more specially to FIG. 1 it is possible to see a pattern support plate 1 with a pattern 2 thereon and functioning as the lower wall of a flask 3 or mold box. There is a filling frame 4 on the flask 3 to form the mold making space with the same. Over this mold space there is a pressurized gas inlet chamber 5, whose top is shut off by a plate 6. A pipe 8 runs from a gas receiver 7 and opens into the inlet space 5 and there is a valve (not shown) with a large cross section in the pipe 8. The means for handling the flask 3 and the filling frame 4 and the means for filling the same with foundry sand may be of conventional design and for this reason are not shown in the figures. The gas pressure needed for the compaction of the foundry sand is supplied from the said gas receiver as shown in the figure, it may be supplied by the ignition of a mixture of air and flammable gas.

A gas permeable diaphragm 10 is placed over the free surface 11 of the foundry sand in the flask 3 and the filling frame 4 and in the present working example of the invention such diaphragm has two zones with different gas permeabilities, namely an outer edge zone 12 with a high permeability to gas and a middle zone 13 with a low permeability to gas. The middle zone is positioned generally over the pattern 2 and more specially over the high part thereof like a flat hump or mesa contour, whereas the zone 12 with a greater permeability to the gas is generally over the part of the pattern plate 1 that is not covered by the said pattern 2.

Figure 4:
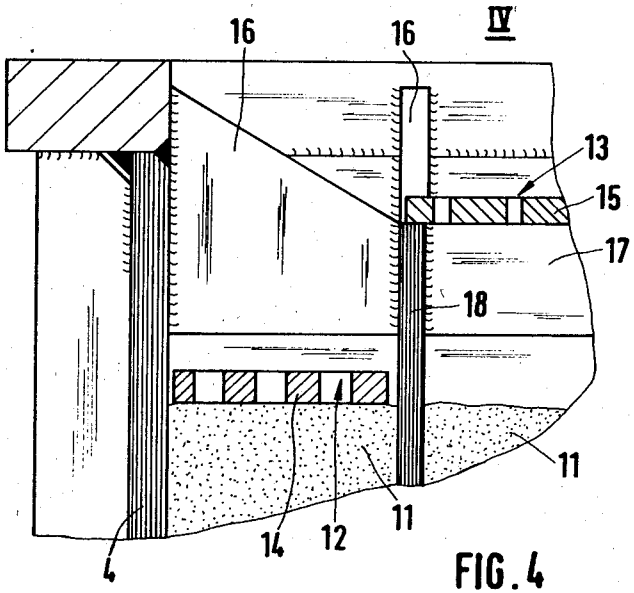
FIG. 4 is a view of the part IV in FIG. 2 on a larger scale.
Figure 2:
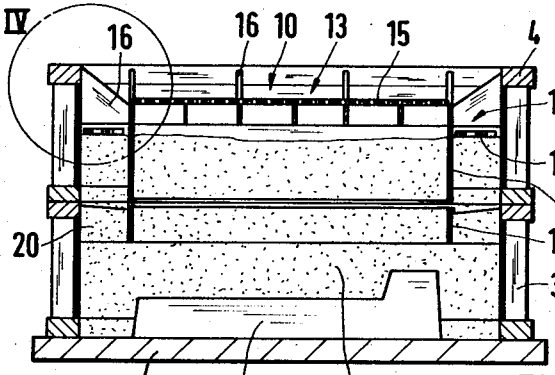
FIG. 2 is a view of a form of the apparatus in keeping with the invention with a flask and a filling frame, as seen in section.
Figure 3:
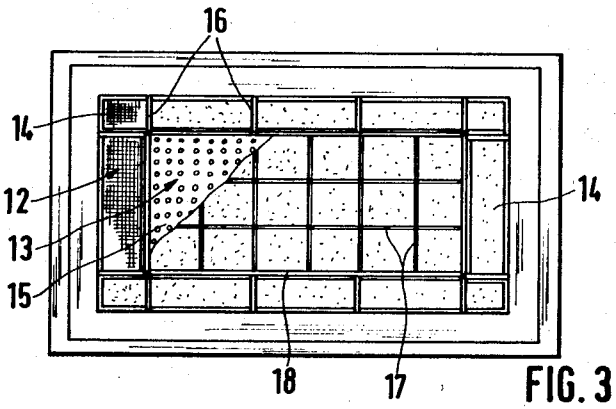
FIG. 3 is a plan view of the example of the invention as in FIG. 2.

In the working example to be seen in FIGS. 2 to 4 the gas permeable diaphragm is made in two parts, one part 14 forming the zone 12 with a greater permeability to gas and the other part 15 forming the zone 13 with a lower permeability to gas. To take an example, the gas permeability in the zone 13 may be at the most 10% of the free cross section of the filling frame.

The part 15 with the zone 13 having a lower permeability to gas is fixed in position in this example of the invention and it may for example be kept in place by way of fins 16 on the filling frame 4, whereas the other part 14 is loosely put in place on the surface of the foundry sand under the fins 16.

The said parts 14 and 15 with different gas permeabilities may each be made of perforated sheets of metal, the perforated sheet of the part 15 with a lower permeability to gas being supported on a grid 17 if desired.

The zones 12 and 13 with different gas permeabilities are separated from each other right down into the filling of foundry sand by separating walls 18, that are fixed on the filling frame by way of the fins 16 together with the stationary or fixed part 15 of the gas permeable diaphragm, such fixing being for example down as far as the level of the flask 3. It is possible for the separating walls 19 with fixing fins 20 to go down further in the top part of the flask 3 like conventional flask bars. In the case of this system the separating walls 19 will come to an end short of the highest part of the contour of the pattern by the necessary distance. With certain forms of pattern it is possible for the parts 14 and 15 to be placed upside down, as for example when it is a question of founding lower parts of bathtubs whose walls are in the edge part of the flask 3. In the case of patterns with outwardly curving walls and having a large volume it is best for the zones 12 and 13 thereof to be vertical as far as the pattern. Furthermore, the separation into zones with different permeabilities to gas may be adapted to different conditions by the pattern.

I claim:

1. In an apparatus for the compaction of foundry sand by the impact of gas under pressure, said foundry sand being placed uncompacted in a flask over a pattern plate with a pattern, using a gas permeable diaphragm means placed directly over the surface of the uncompacted foundry sand and on which the gas under pressure is caused to act, the improvement wherein the diaphragm means has a permeability to gas that is so matched to the height of the foundry sand to be compacted that said permeability is less where said pattern has a high contour than where said pattern plate is free of pattern.

2. The apparatus as claimed in claim 1 wherein said gas permeable diaphragm means comprises at least one piece of perforated sheet metal with blow holes therein having a cross section dimensioned for a desired permeability.

3. The apparatus as claimed in claim 1 wherein said gas permeable diaphragm means is partly fixed stationarily in place and is partly placed loosely on the surface of the foundry sand so that it may be moved therewith.

4. The apparatus as claimed in claim 1 wherein said diaphragm means is fixed stationarily in place in the part over said pattern and in the part over the uncovered pattern plate it may be moved.

5. The apparatus as claimed in claim 1 wherein the gas permeable diaphragm means is placed on the surface of the uncompacted foundry sand and may be moved therewith and wherein the amount of mass of the diaphragm means in the zone where the pattern has a high contour is less than in the pattern-free part of the pattern plate.

6. The apparatus as claimed in claim 1 comprising at least one separating wall running down into said foundry sand in line with zones of said diaphragm means that have different permeabilities to gas, such zones furthermore being separated from each other in a vertical direction thereby.

7. The apparatus as claimed in claim 6 wherein the at least one separating wall is only placed on a stationary part of the gas permeable diaphragm means, said wall running downwards into said flask.

8. The apparatus as claimed in claim 6 comprising a filling frame placed on the flask and having said gas permeable diaphragm means within it.

9. The apparatus as claimed in claim 8 wherein said at least one separating wall is divided in a vertical direction into a top wall part that is fixed stationarily in place on the filling frame and a lower part is fixed stationarily in place on and in the said flask.

10. In an apparatus for the compaction of foundry sand by the impact of gas under pressure, said foundry sand being placed uncompacted in a flask over a pattern plate with a pattern, using a gas permeable diaphragm means placed directly over the surface of the uncompacted foundry sand and on which the gas under pressure is caused to act, the improvement wherein the diaphragm means has a permeability to gas that is so matched to the height of the foundry sand to be compacted that said permeability is less where said pattern has a plateau-like contour than where said pattern plate is free of pattern.

11. The apparatus as claimed in claim 10, wherein the gas permeable diaphragm means is placed on the surface of the uncompacted foundry sand and may be moved therewith, and wherein the amount of mass of the diaphragm means in the zone where the pattern has a plateau-like contour is less than in the pattern-free part of the pattern plate.

12. In an apparatus for the compaction of foundry sand by the impact of gas under pressure, said foundry sand being placed uncompacted in a flask over a pattern plate with a pattern, using a gas permeable diaphragm means placed directly over the surface of the uncompacted foundry sand and on which the gas under pressure is caused to act, the improvement wherein the diaphragm means has a permeability to gas that is to matched to the height of the foundry sand to be compacted that said permeability is less where said pattern has a high and plateau-like contour than where said pattern plate is free of pattern.

13. The apparatus as claimed in claim 12, wherein the gas permeable diaphragm means is placed on the surface of the uncompacted foundry sand and may be moved therewith, and wherein the amount of mass of the diaphragm means in the zone where the pattern has a high and plateau-like contour is less than in the pattern-free part of the pattern plate.

* * * * *